US005303792A

United States Patent [19]

Shimizu

[11] Patent Number: 5,303,792

[45] Date of Patent: Apr. 19, 1994

[54] AMORING STRUCTURE FOR CONSTRUCTION MACHINES

[75] Inventor: Yutaka Shimizu, Saitama, Japan

[73] Assignees: Kabushiki Kaisha Komatsu Seisakusho; Komatsu Zenoa Kabushiki Kaisha, both of Tokyo, Japan

[21] Appl. No.: 101,344

[22] Filed: Aug. 2, 1993

Related U.S. Application Data

[63] Continuation of Ser. No. 848,975, Apr. 15, 1992, abandoned.

[30] Foreign Application Priority Data

Oct. 23, 1989 [JP] Japan ..... 1-123105[U]
Nov. 9, 1989 [JP] Japan ..... 1-130157[U]

[51] Int. Cl.[5] ..... B62D 25/20; B62D 25/10

[52] U.S. Cl. ..... 180/89.17; 180/69.21; 180/90.6

[58] Field of Search ..... 180/69.2, 69.21, 69.24, 180/89.12, 89.13, 89.14, 89.16, 89.17, 89.18, 89.19, 90.6; 296/187, 901

[56] References Cited

U.S. PATENT DOCUMENTS

| | | | |
|---|---|---|---|
| 3,981,375 | 9/1976 | Crawford | 180/69.21 |
| 4,040,501 | 8/1977 | Haswell | 180/69.21 X |
| 4,090,579 | 5/1978 | Stedman | 180/69.2 |
| 4,099,590 | 7/1978 | Martin, Sr. | 180/69.21 |
| 4,695,342 | 9/1987 | Belleau et al. | 296/901 X |
| 5,020,846 | 6/1991 | Bonnett | 296/901 X |

FOREIGN PATENT DOCUMENTS

| | | | |
|---|---|---|---|
| 221449 | 11/1957 | Australia | 180/69.21 |
| 2716223 | 10/1977 | Fed. Rep. of Germany | 180/89.16 |
| 1010710 | 6/1952 | France | 180/89.17 |
| 5490509 | 12/1952 | Japan . | |
| 54158401 | 4/1953 | Japan . | |
| 54181703 | 6/1953 | Japan . | |
| 58-39369 | 9/1983 | Japan . | |
| 0160784 | 6/1989 | Japan | 296/901 |

*Primary Examiner*—Brian L. Johnson
*Attorney, Agent, or Firm*—Flynn, Thiel, Boutell & Tanis

[57] ABSTRACT

An engine cover and floor structure for a construction machine, having an upper swing body (3) is provided on a lower self-propelled crawler (1) so that the upper swing body (3) can be turned, a working machine (4) at the front portion of the upper swing body (3), and an engine room (6) which is enclosed with an engine room cover (5) at the rear portion thereof. The cover (5) is formed integrally so that the cover (5) as a whole can be opened and closed, whereby the construction of the engine cover is simplified. A floor plate (10*a*) with which the front upper surface of the upper swing body (3) is covered, a lever stand (10*c*) and an outer circumferential frame (10*b*) are molded integrally out of a fiber-reinforced plastic to form an armoring body (10), which is fixed detachably to the upper swing body (3).

2 Claims, 8 Drawing Sheets

AMORING STRUCTURE FOR CONSTRUCTION MACHINES

This application is a continuation-in-part of U.S. Ser. No. 07/848 975, filed Apr. 15, 1992 and now abandoned.

TECHNICAL FIELD

The present invention relates to vehicle body portion providing an armoring structure for a construction machine such as a power shovel.

BACKGROUND TECHNOLOGY

A conventional construction machine such as a power shovel, as illustrated in FIG. 4, comprises a lower crawler b which is self-propelled by a crawler belt a, an upper swing body c which is provided on the lower self-propelled crawler b, a working machine d and an engine room e which are mounted on the front and rear portion of the upper swing body c.

The engine room e is enclosed with an engine room cover f which is openable for facilitating to inspect the engine room e and to repair the engine.

The engine room cover f, which encloses the engine room e, is generally opened partially in such a manner that the upper portion of the cover is opened, as illustrated in FIG. 4, or the rear half of the cover is opened, as illustrated in FIG. 5, or the front half of the cover is opened, as illustrated in FIG. 6.

However, these covers have the following drawbacks.

(1) Since a fixed portion of the cover and an openable or movable portion of the same should be manufactured separately, the number of parts of the cover and processes of manufacturing the cover are increased, which involves high cost.

(2) A shape of the jointing portion defined between the fixed portion and the movable portion is complicated, the jointing portion is liable to generate a gap or a difference in the surface level thereof.

FIG. 7 is a view showing another example of a conventional power shovel in which elements which are the same as those of the power shovel in FIG. 4 are denoted at the same numerals and the explanation thereof is omitted.

A working oil tank g, a floor plate h, a lever stand cover i which constitute parts of the armoring structure and fixed to the upper swing body c in the same way as the engine cover f is fixed to the upper swing body c.

(3) According to the construction machine as illustrated in FIG. 7, since almost all parts of the armoring structure fixed to the upper swing body c are manufactured by a sheet metal process, the parts of the armoring structure have complicated shapes and are costly. Particularly, in the construction machine which is manufactured in small numbers, the cost of the parts of the armoring structure increases the cost of the construction machine. Some upper swing bodies c have an outer frame k at the periphery thereof to improve an external appearance thereof, as illustrated in FIG. 10, which increases the cost of the upper swing body c.

The present invention has been made to solve the drawbacks (1), (2) and (3) as set forth above and to provide an armoring structure of the construction machine capable of opening and closing the entire engine room cover whereby the structure of the engine room cover is simplified and the number of parts of the armoring structures is reduced to thereby reduce the cost of the construction machine.

SUMMARY OF THE INVENTION

In order to achieve the above object, the present invention enables an engine room cover to be integrally formed and to be opened or closed as a whole in a construction machine provided with an upper swing body on a lower crawler which is self-propelled by a crawler belt, and further provided with a working machine at the front portion of the upper swing body and an engine room which is enclosed with an engine room cover.

With the arrangement set forth above, it is possible to obtain the construction machine having the engine room cover simplified in structure by eliminating the fixed portion of the engine room cover at the rear portion thereof.

Furthermore, the present invention is to provide the armoring structure of the construction machine, which is provided with a floor plate 10*a* with which the front upper surface, outer front periphery and side peripheries of the upper swing body 3 are covered, a lever stand 10*c* and an outer circumferential frame 10*b* are molded integrally out of a fiber-reinforced resin to form an armoring body 10, which is fixed detachably to the upper swing body 3, whereby the parts of the armoring structure, which are conventionally manufactured separately, can be integrally manufactured and the number of the parts of the armoring structure can be reduced.

BEST MODE FOR CARRYING OUT THE INVENTION

An armoring structure of a construction machine according to a first embodiment of the present invention will be described with reference to FIG. 1.

Figure 1:
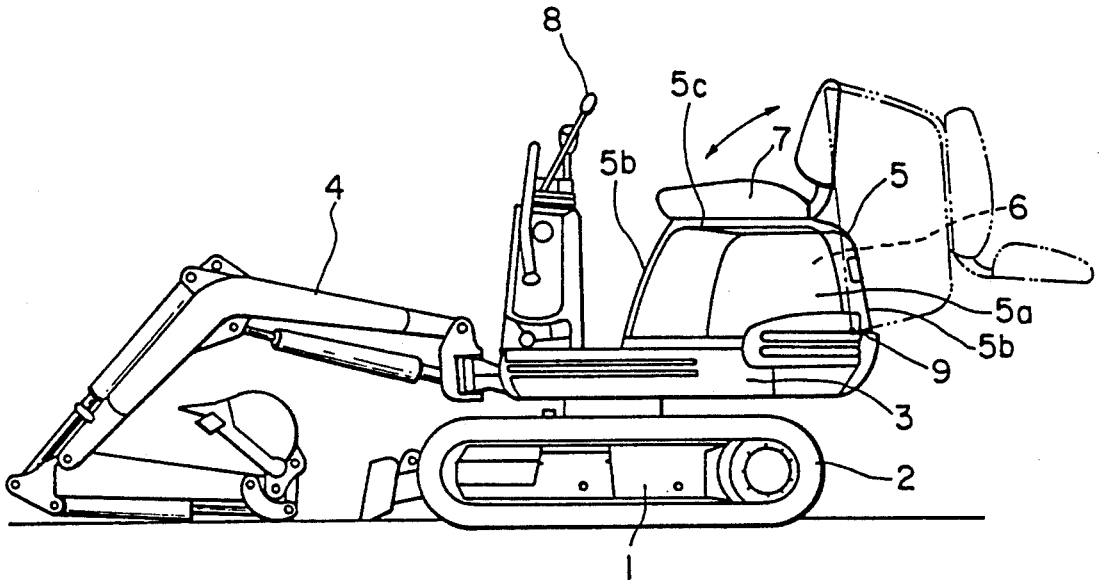
FIG. 1 is a side view showing an entire arrangement of a construction machine according to a first embodiment.

In FIG. 1, designated at 1 is a lower self-propelled crawler which is self-propelled by a crawler belt 2 and an upper swing body 3 is provided on the lower self-propelled crawler so that the swing body 3 can be turned. A working machine 4 is provided at the front portion of the upper swing body 3 and an engine room 6, which is enclosed with an engine room cover 5, is provided at the rear portion thereof.

The engine room cover 5 is formed integrally by right and left side walls 5*a*, front and rear walls 5*b* and an upper surface plate 5*c* in which the lower portion of the rear wall 5*b* is hinged to the upper swing body 3 by a hinge 9 about which the engine room cover 5 can be opened rearward as a whole.

A driver seat 7 is attached to the upper surface plate 5*c* of the engine room cover 5 and a group of operation levers 8 are provided in front of the driver seat 7.

Figure 2:
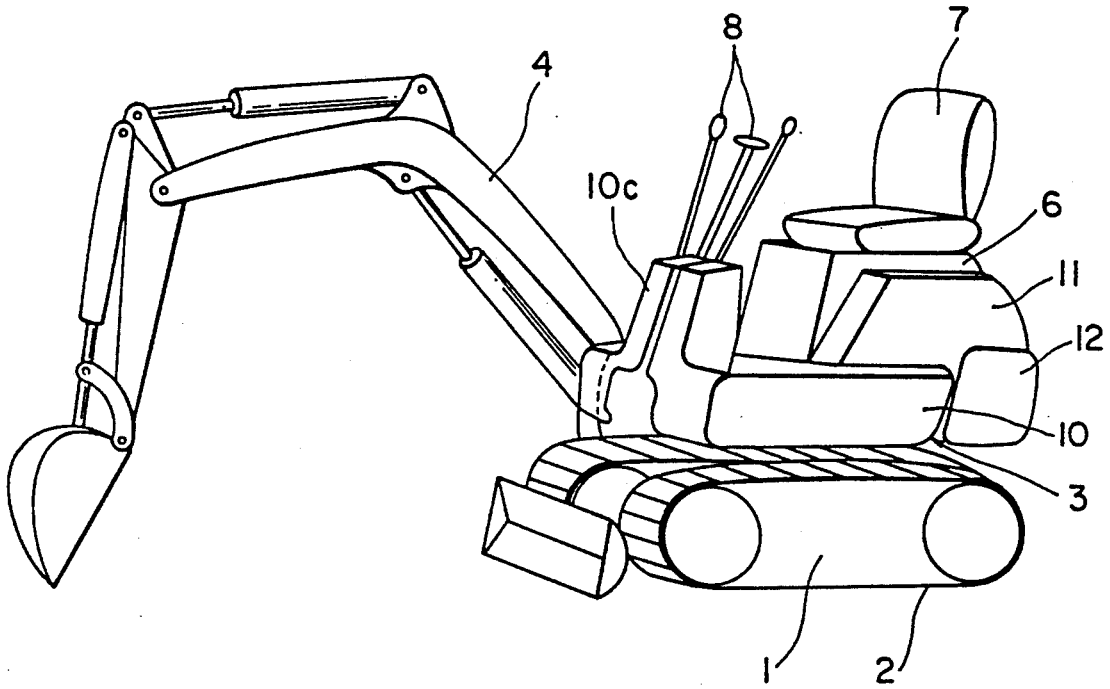
FIG. 2 is a perspective view showing an entire arrangement of a construction machine according to a second embodiment.

FIG. 2 shows an armoring structure of a construction machine according to another embodiment of the present invention wherein elements which are the same as those of the construction machine as illustrated in FIG. 1 are denoted at the same numerals and the explanation thereof is omitted.

The swing body 3 has the working machine 4 which is provided at the front portion thereof and the engine room 6 which is provided at the rear portion thereof for housing an engine therein, and further has an armoring body 10 which is attached to the front upper portion thereof.

Figure 3:
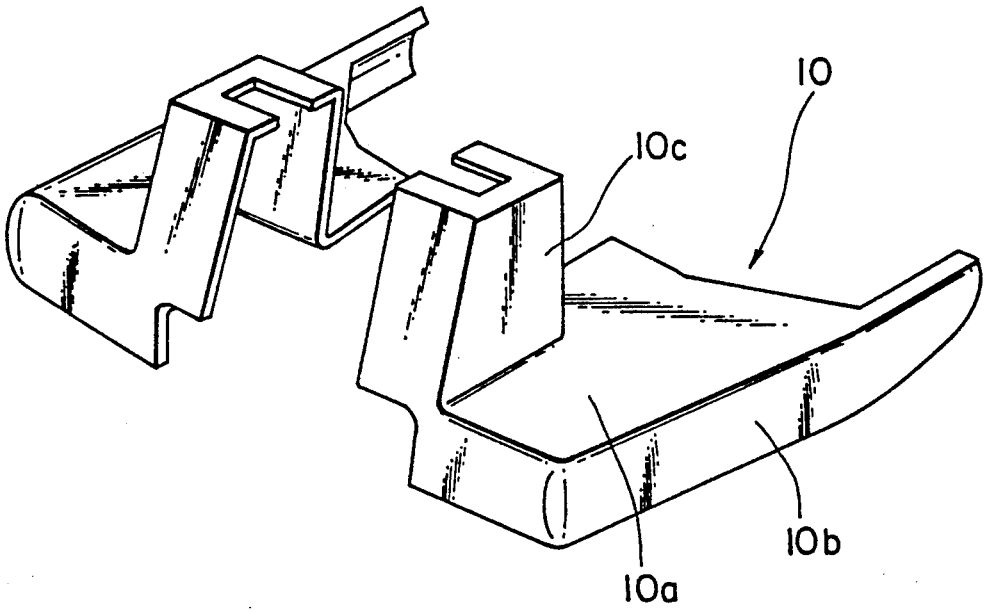
FIG. 3 is a perspective view showing an armoring structure of the construction machine in FIG, 2.
Figure 4:
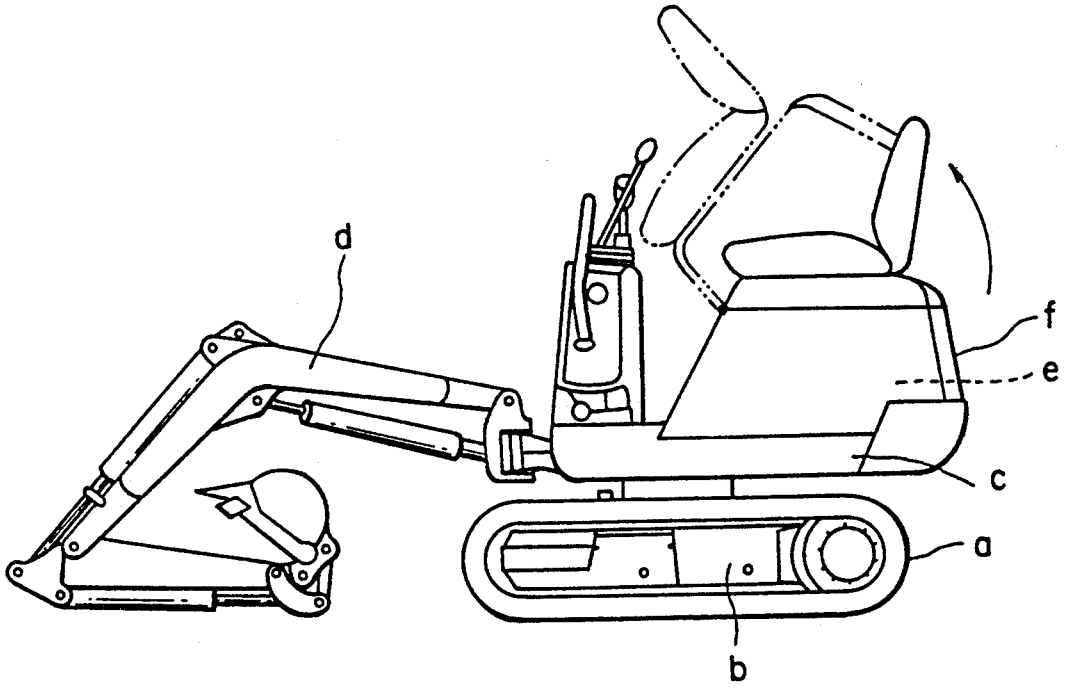
FIG. 4 (PRIOR ART)
FIGS. 4 to 6 are side views explaining armoring structures in conventional construction machines.
Figure 5:
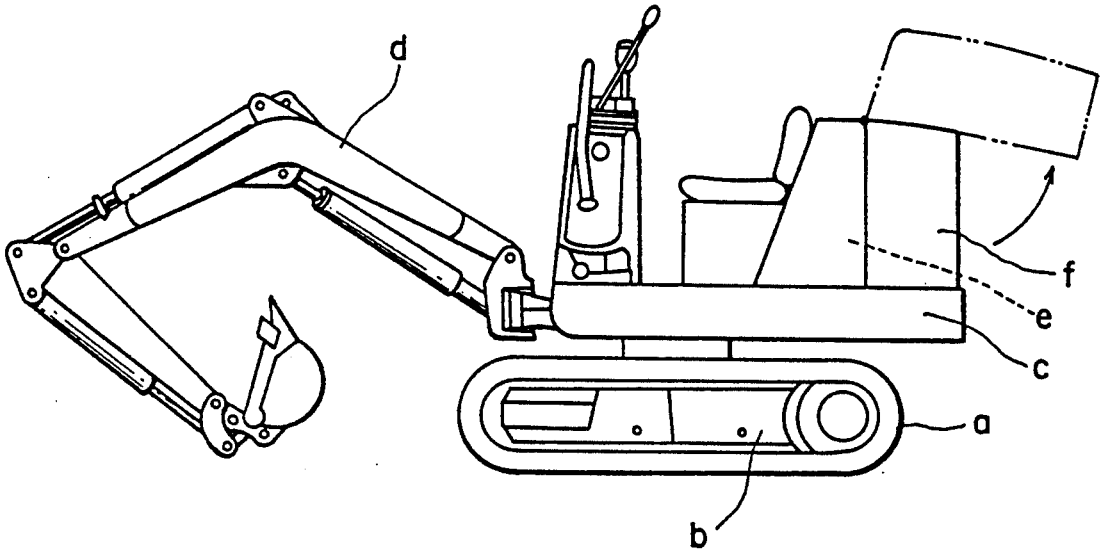
FIG. 5 (PRIOR ART)
Figure 6:
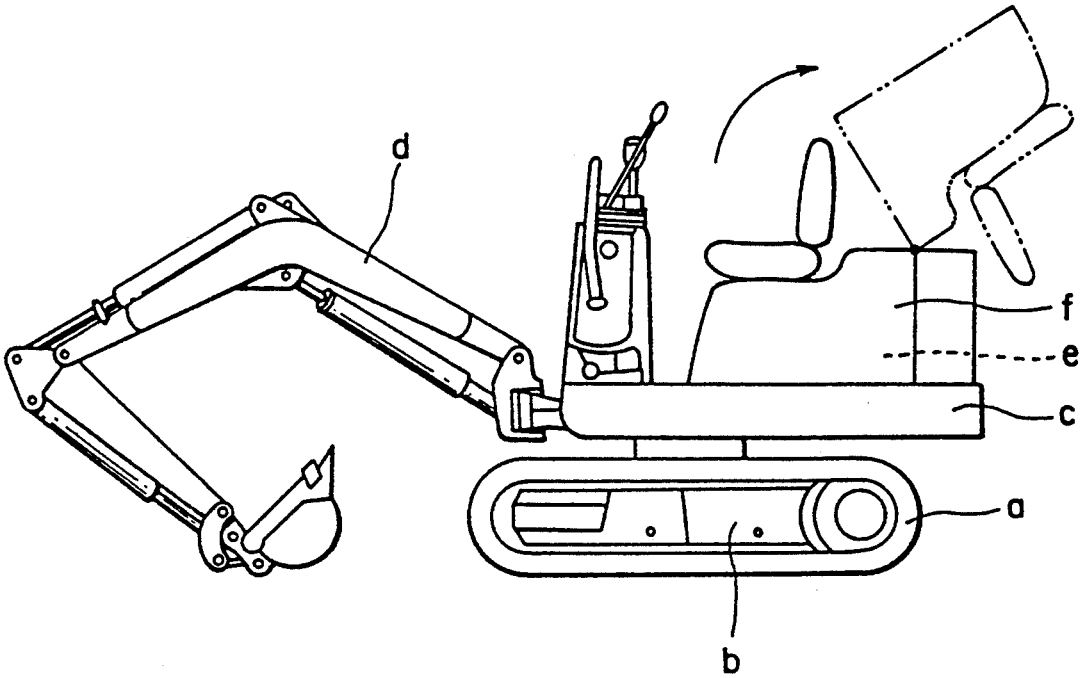
FIG. 6 (PRIOR ART)
Figure 7:
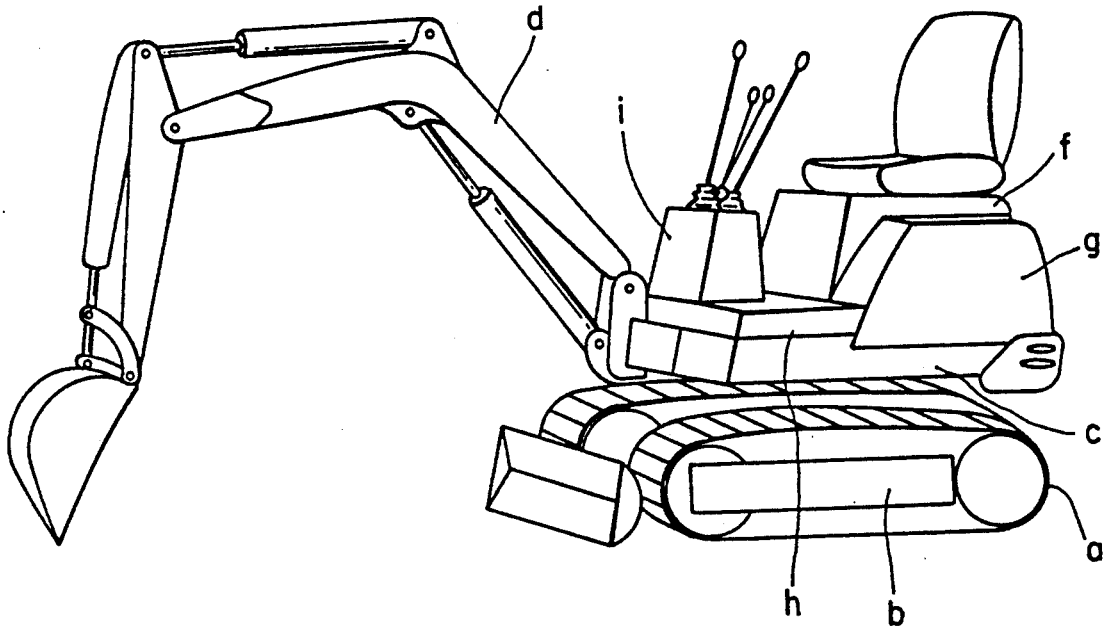
FIG. 7 (PRIOR ART)
FIG. 7 is a perspective view showing another conventional construction machine and FIG. 8 is a perspective view of the lever stand cover i of FIG. 7.
Figure 8:
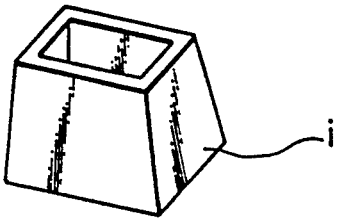
FIG. 8 ( PRIOR ART)
Figure 9:
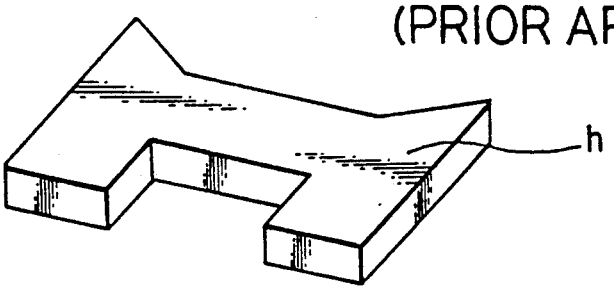
FIG. 9 (PRIOR ART)
FIG. 9 is a perspective view of the floor plate h of FIG. 7.
Figure 10:
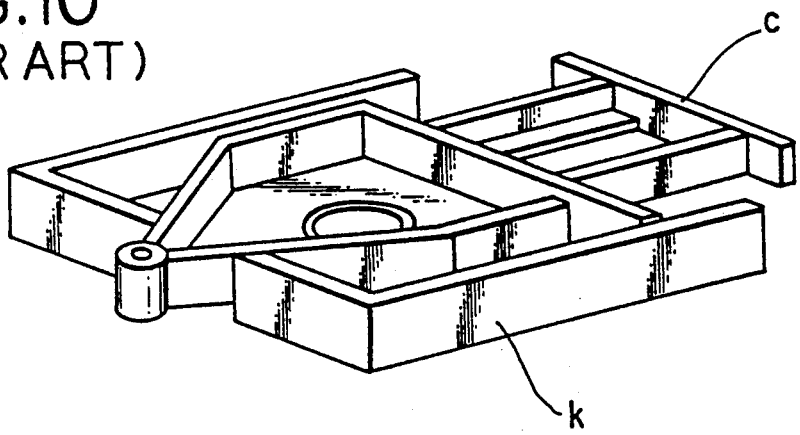
FIG. 10 (PRIOR ART)
FIG. 10 is a perspective view of the upper swing body c and out frame k of FIG. 7.

The armoring body 10 has a structure integrating the conventional floor plate, lever stand and outer frame which is provided on the circumference of the upper swing body 3 as illustrated in FIG. 3.

The armoring body 10 is formed integrally out of a fiber-reinforced plastic (FRP) and comprises a floor plate 10*a*, an outer frame 10*b* which is formed at the front side and both side edges of the floor plate 10*a* and a lever stand 10*c* which protrudes from the front upper surface of the floor plate 10*a* as illustrated in FIG. 3.

The armoring body 10 is divided into two portions at right and left side thereof for facilitating the attachment to the upper swing body 3.

The armoring body 10 is detachably attached to the upper swing body 3 for facilitating the inspection and repair of a linkage or various instruments which are provided under the floor plate 10*a*. Various operation levers 8 protrude from the lever stand 10*c*.

The driver seat 7 is provided over the engine room 6 and working oil tanks 11 and a bumper 12 are provided at both sides and rear portion of the armoring body 10.

INDUSTRIAL UTILIZATION

Since the engine room cover which encloses the engine room is formed integrally and the engine room cover is opened as a whole according to the present invention as mentioned in detail above, the structure of the engine room cover is simplified compared with the conventional engine room cover which is partially opened so that the engine room cover can be manufactured with ease by a small number of processes.

As a result, the cost of the construction machine can be reduced. Furthermore, since the gap or the difference in the surface level is not generated in the jointing portion defined between the fixed portion and the openable portion of the engine room cover, water is prevented from entering the engine room while the external appearance is not adversely affected.

Furthermore, since the parts of the armoring structure such as the outer frame, the floor plate, the lever stand, etc., which are manufactured conventionally and separately, can be molded integrally out of the fiber-reinforced plastic and attached to the upper swing body, the cost of the parts of the armoring structure can be reduced remarkably and the number of he parts can be reduced so that the number of processes involved in the assembly thereof can be reduced compared with those of the conventional armoring structure which are manufactured separately.

Still furthermore, since the complicated shape is molded by resin with ease, the cost for manufacturing the armoring body can be reduced compared with the armoring body manufactured by the sheet metal process.

I claim:

1. A construction machine comprising a lower crawler body propelled by a crawler belt, an upper swing body disposed on said lower crawler body for turning movement thereon and including an upstanding operating lever, an upper swing body cover bifurcated to comprise right and left molded plastic cover portions each having a floor plate portion, a lever cover portion that extends upwardly from the respective floor plate portion, and outer peripheral front and side frame portions that extend downwardly from the respective floor plate portion, said right and left cover portions being assembled on said upper swing body so that together the floor plate portions thereof cover an upper surface of said upper swing body, the lever cover portions thereof are disposed about said upstanding operating lever and said front and side frame portions thereof cover an outer front and side periphery of said upper swing body, a working machine disposed at a front portion of said upper swing body, an engine room disposed at a rear portion of said upper swing body, an engine room cover disposed on said upper swing body proximate said engine room, said engine room cover comprising a one-piece, molded plastic cover member mounted to said upper swing body for movement between a closed position enclosing said engine room and an open position providing access to said engine room, and a seat disposed on said cover member for movement therewith when said cover member is moved between said closed and open positions.

2. A construction machine comprising a lower crawler body propelled by a crawler belt, an upper swing body disposed on said lower crawler body for turning movement thereon and including an upstanding operating lever, an upper swing body cover bifurcated to comprise right and left molded plastic cover portions each having a floor plate portion, a lever cover portion that extends upwardly from the respective floor plate portion, and outer peripheral front and side frame portions that extend downwardly from the respective floor plate portion, said right and left cover portions being assembled on said upper swing body so that together the floor plate portions thereof cover an upper surface of said upper swing body, the lever cover portions thereof are disposed about said upstanding operating lever and said front and side frame portions thereof cover an outer front and side periphery of said upper swing body, and a working machine disposed at a front portion of said upper swing body.

* * * * *

UNITED STATES PATENT AND TRADEMARK OFFICE

CERTIFICATE OF CORRECTION

PATENT NO. : 5 303 792

DATED : April 19, 1994

INVENTOR(S) : Yutaka Shimizu

It is certified that error appears in the above-identified patent and that said Letters Patent is hereby corrected as shown below:

On the title page, [54]; please change the title to:

---ENGINE COVER AND FLOOR STRUCTURE FOR CONSTRUCTION VEHICLES---.

On the title page, please change "[22] Filed: Aug. 2, 1993" to the following PCT information:

---[22] PCT Filed: Oct. 22, 1990

[86] PCT No.: PCT/JP90/01362

§ 371 Date: Apr. 15, 1992

§ 102(e) Date: Apr. 15, 1992

[87] PCT Pub. No.: WO91/05920

PCT Pub. Date: May 2, 1991---.

Signed and Sealed this

Twentieth Day of September, 1994

*Attest:*

*Attesting Officer*

BRUCE LEHMAN

*Commissioner of Patents and Trademarks*